US008607820B2

(12) United States Patent
Lenk

(10) Patent No.: US 8,607,820 B2
(45) Date of Patent: Dec. 17, 2013

(54) DEVICE FOR CONTINUOUSLY MIXING FED-OUT NATURAL GAS WITH OXYGEN TO PRODUCE A BURNABLE GAS FOR HEATING THE PRESSURIZED NATURAL GAS BEFORE OR AFTER THE RELAXATION THEREOF

(75) Inventor: Andreas Lenk, Wardenburg (DE)

(73) Assignee: EWE Gasspeicher GmbH, Oldenburg (DE)

( * ) Notice: Subject to any disclaimer, the term of this patent is extended or adjusted under 35 U.S.C. 154(b) by 340 days.

(21) Appl. No.: 12/737,590

(22) PCT Filed: May 12, 2009

(86) PCT No.: PCT/DE2009/000666

§ 371 (c)(1),
(2), (4) Date: Jan. 28, 2011

(87) PCT Pub. No.: WO2010/015215

PCT Pub. Date: Feb. 11, 2010

(65) Prior Publication Data

US 2011/0132481 A1 Jun. 9, 2011

(30) Foreign Application Priority Data

Aug. 4, 2008 (DE) ..... 10 2008 036 269

(51) Int. Cl.
*F15D 1/00* (2006.01)
*B01F 3/02* (2006.01)
*B01F 5/06* (2006.01)

(52) U.S. Cl.
USPC ..... 137/592; 137/602; 137/590; 137/240

(58) Field of Classification Search
USPC ..... 137/602, 240, 238, 592, 590
See application file for complete search history.

(56) References Cited

U.S. PATENT DOCUMENTS 3,330,773 A 7/1967 De Hart, Jr.
5,003,782 A 4/1991 Kucerija (Continued)

FOREIGN PATENT DOCUMENTS

EP 0 529 474 3/1993
EP 0 635 673 1/1995

(Continued)

OTHER PUBLICATIONS

International Search Report, Nov. 2010.

*Primary Examiner* — Kevin Lee
(74) *Attorney, Agent, or Firm* — Collard & Roe, P.C.

(57) ABSTRACT

The invention relates to a device for continuously mixing fed-out natural gas with oxygen to produce a burnable gas used for heating the pressurized natural gas before or after the relaxation thereof, comprising a mixing section having connections for a natural gas supply line, an oxygen infeed line, and a burnable gas discharge line. The mixing section is designed as a closed mixing container, which has a mixing chamber, at the center of which forming a mixing zone a distributing pipe for oxygen is disposed that is joined to the connection for oxygen infeed. The mixing chamber is filled completely, and the distributing pipe is filled at least partially, with a packing of ceramic granular material. The mixing chamber of the mixing container is equipped with temperature sensors for temperature measurement. The mixing container is designed as a standing container, which at the bottom has the connection of the natural gas supply and at the top the connection for the burnable gas discharge.

12 Claims, 3 Drawing Sheets

(56) References Cited

U.S. PATENT DOCUMENTS

| | | | | |
|---|---|---|---|---|
| 6,372,190 | B1 * | 4/2002 | Zehe et al. | 137/240 |
| 6,730,272 | B2 | 5/2004 | Reimert | |
| 6,969,250 | B1 * | 11/2005 | Kawamura et al. | 431/185 |
| 7,051,752 | B2 * | 5/2006 | Fiebig | 137/240 |
| 7,195,026 | B2 * | 3/2007 | Znamensky et al. | 137/240 |
| 2005/0095185 | A1 | 5/2005 | Gary | |
| 2005/0095186 | A1 | 5/2005 | McGee | |
| 2007/0283705 | A1 | 12/2007 | Taylor | |

FOREIGN PATENT DOCUMENTS

| | | |
|---|---|---|
| EP | 0 920 578 | 8/2003 |
| RU | 2 191 907 | 10/2002 |
| SU | 780868 | 11/1980 |
| WO | 03/053559 | 7/2003 |
| WO | 2005/044431 | 5/2005 |

* cited by examiner

DEVICE FOR CONTINUOUSLY MIXING FED-OUT NATURAL GAS WITH OXYGEN TO PRODUCE A BURNABLE GAS FOR HEATING THE PRESSURIZED NATURAL GAS BEFORE OR AFTER THE RELAXATION THEREOF

CROSS REFERENCE TO RELATED APPLICATIONS

This application is the National Stage of PCT/DE2009/000666 filed on May 12, 2009, which claims priority under 35 U.S.C. §119 of German Application No. 10 2008 036 269.7 filed on Aug. 4, 2008, the disclosure of which is incorporated by reference. The international application under PCT article 21(2) was not published in English.

BACKGROUND OF THE INVENTION

1. Field of the Invention

The invention relates to a device for continuously mixing fed-out natural gas with oxygen to produce a burnable gas for heating the pressurised natural gas before or after the relaxation thereof, with a closed mixing container with connection for a natural gas supply line, an oxygen in-feed line and a burnable gas discharge line.

2. The Prior Art

On removal from storage, e.g. from underground storage tanks, natural gas must be preheated before its pressure is reduced in order to compensate for the Joule-Thomson effect. The continuous burning of part of the removal flow in a so-called "in-line reactor" with the controlled supply oxygen is known. In this method, through the catalytic conversion of oxygen with natural gas, temperatures of up to 400° C. are reached directly in the gas flow being removed from the store. The heat is used for continuous heating through directly mixing the hot combustion gas into the cold gas flow. This method is described in EP 0 920 578 B1.

It has been shown that self-ignition of the gas mixture during the process of supplying oxygen to the natural can never be entirely ruled out. The self-ignition of natural gas-oxygen mixtures is dependent on pressure and temperature. Even without a catalyst an increased oxygen content is enough to result in a reaction and combustion in the gas flow, and therefore in an increase in pressure and temperature. In the real technical conditions of a natural gas withdrawal plant, with the currently known and available measuring and control technology and in connection with the safety measures that can be implemented with currently known means, the supplying of oxygen to natural gas by means of a burner, diffusion burner or a premixing chamber as described in EP 0 920 578 cannot be controlled with certainty.

In view of the high temperatures arising during direct ignition at the oxygen discharge point, the free flowing in of oxygen into the natural gas flow is not recommended. Furthermore the use of known ignition and monitoring devices will fail after a very short period of time.

On the other hand it has been shown that "cold" adding of oxygen to the natural gas for an exothermic reaction on a Catalyst is not successful. The preheating of the natural gas-oxygen mixture to the activation temperature of the catalyst with the concentration remaining the same before relaxation regularly leads to uncontrollable self-ignition and consequently not to the required catalytic conversion of the mixture of natural gas and oxygen.

SUMMARY OF THE INVENTION

The aim of the invention is to provide a device which guarantees the safe supplying of oxygen to continuously flowing natural gas.

This aim is achieved through the features of claim 1.

Further embodiments and advantageous further developments of the device in accordance with the invention are set out in claims 2 to 11.

In accordance with the invention, the mixing section envisaged in the known "in-line heating", i.e. within the natural gas line, is now designed as a closed mixing container. Its function is to add high-pressure oxygen in the gaseous state at a temperature of approx. 5 to 30° C. to a cold natural gas flow via the oxygen in-feed line and to mix it with the natural gas in the mixing chamber of the container via the distributing pipe at a high pressure of, for example, 70 to 170 bars.

The mixing chamber is filled completely, and the distributing pipe is filled at least partially with a packing of ceramic granular material making self-ignition more difficult. The packing of ceramic granular material assures increased operational safety as it exhibits inert behaviour and does not therefore take part in a reaction with the gases to be mixed. It exhibits very low and therefore advantageous thermal conductivity, so that heat released during possible ignition within the mixing container cannot damage the container walls.

The material also has the advantageous property of having a high melting point as a result of which no melt channels can be formed in the event of ignition.

The mixing chamber of the container is also equipped with temperature sensors which form part of the safety system of the device.

The mixing container is advantageously designed as a standing container which at the bottom has the connection for the natural gas line and at the top the connection for the burnable gas discharge line.

The advantageous operating principle of the device allows cold mixing of oxygen and natural gas at high pressures at a certain concentration centrally in a standing container equipped with the ceramic packing and safety monitoring by way of measuring sensors. Due to its high density in small defined hollow spaces, the packing, with its insulating and inert effect, filled into the container is both discharge and wear resistant. This prevents the spreading of flames within the container should self-ignition take place. The temperature of the inner wall of the container is also monitored.

As the container is standing the packing remains constant during operation and always exhibits small hollow spaces, so that if particles of the ceramic granular material are torn away by the strong flow, sliding back into place takes place immediately.

This sliding back is further improved in that the ceramic granular material of the packing is a highly compacted aluminium oxide in spherical form with a homogeneous particle size distribution of 1.5 to 3 mm.

A further safety measure against ignition within the container during mixing of the burnable gas produced from natural gas and oxygen is that on the supply side the mixing zone has a concentrically narrowed cross-section which increases the flow speed into the mixing zone.

In the area of the actual mixing zone in the container the flow speed of the inflowing natural gas is increased by the concentrically narrowed cross-section, which can also be described as a built-in reduction, is increased in such a way that the produced turbulence in the natural gas flow brings about optimum mixing with the supplied oxygen in the area surrounding the mixing pipe. The area of ignition of the natural gas-oxygen mixture, i.e. the burnable gas, is therefore traversed very quickly. The inert ceramic packing material also prevents flame development.

In its pipe wall, which runs parallel to the surrounding walls of the mixing container, the distributing pipe has outlet slits. The outlet slits are advantageously dimensioned in such a way that particles of the granular ceramic packaging also present in distributing pipe cannot be carried though the outlet slits by the oxygen flowing in the distributing pipe or be pushed into the distributing pipe from outside. The outlet slits have the effect of a sieve with a simultaneous advantageous effect on the mixing action of the oxygen flowing out of the distributing pipe through the outlet slits into the mixing zone.

Advantageously the mixing container is designed with a double wall in the area of the mixing zone of the mixing chamber, whereby an insulating material is arranged between the outer mixing container well and the inner mixing chamber wall. The inner mixing chamber wall can, for example, be made of stainless steel sheet metal which is welded circumferentially to the outer mixing container wall, whereby in the intermediate spaces a lining of ceramic wool is arranged in order to protect the mixing chamber wall from thermal influences.

All measures and fittings have the effect of reducing the risks of self-ignition during the continuous mixing of oxygen and flow of natural gas within the mixing container of the device in accordance with the invention.

A particularly advantageous contribution to this is the fact that on the inner mixing chamber wall, in an area corresponding to the arrangement of the outlet slits on the distributing pipe, several temperature sensors with a protective tube are arranged evenly distributed around the circumference of the outer mixing container wall.

Advantageously, in the area of the oxygen outlet slits, three rapidly reacting temperature sensors with a protective tube are welded into the inner mixing chamber wall, evenly distributed around the circumference. This allows the temperature increase in the event of possible ignition of the natural gas-oxygen to be permanently and securely, monitored. The temperature sensors are integrated into a safety system.

Particularly advantageously the safety system has a nitrogen flushing system connected to the oxygen supply line. On reaching a temperature increase measured by the temperature sensors in the mixing container, the oxygen supply is immediately stopped by the safety device and a flushing process with nitrogen is initiated in the connection for the oxygen in-feed line.

Also contributing to the further development of the solution in accordance with the invention is the fact that a redundant measuring and control device is integrated into both the oxygen in-feed line and natural gas supply line. This allows a precise supply of the oxygen up to, for example, max. 3 mol %. The safety system limits this oxygen concentration whereby monitoring is carried out by the measuring and control device. Used in each of the lines for supplying the natural gas and the oxygen are two different series-connected throughflow measuring methods, namely differential pressure measurement at an aperture and ultrasonic measurement, the values of which are processed in the safety device. On the one hand this results in redundancy, and on the other hand it provides a possibility for comparison.

Determined by experiments, the preselected parameters of the mixing process are below the self-ignition parameters of the burnable gas produced by mixing natural gas and oxygen, whereby the situation in the process is permanently monitored by safety-orientated measuring technology.

An example of embodiment of the invention, setting out further inventive features, is shown in the drawings.

DETAILED DESCRIPTION OF THE PREFERRED EMBODIMENTS

Figure 1:
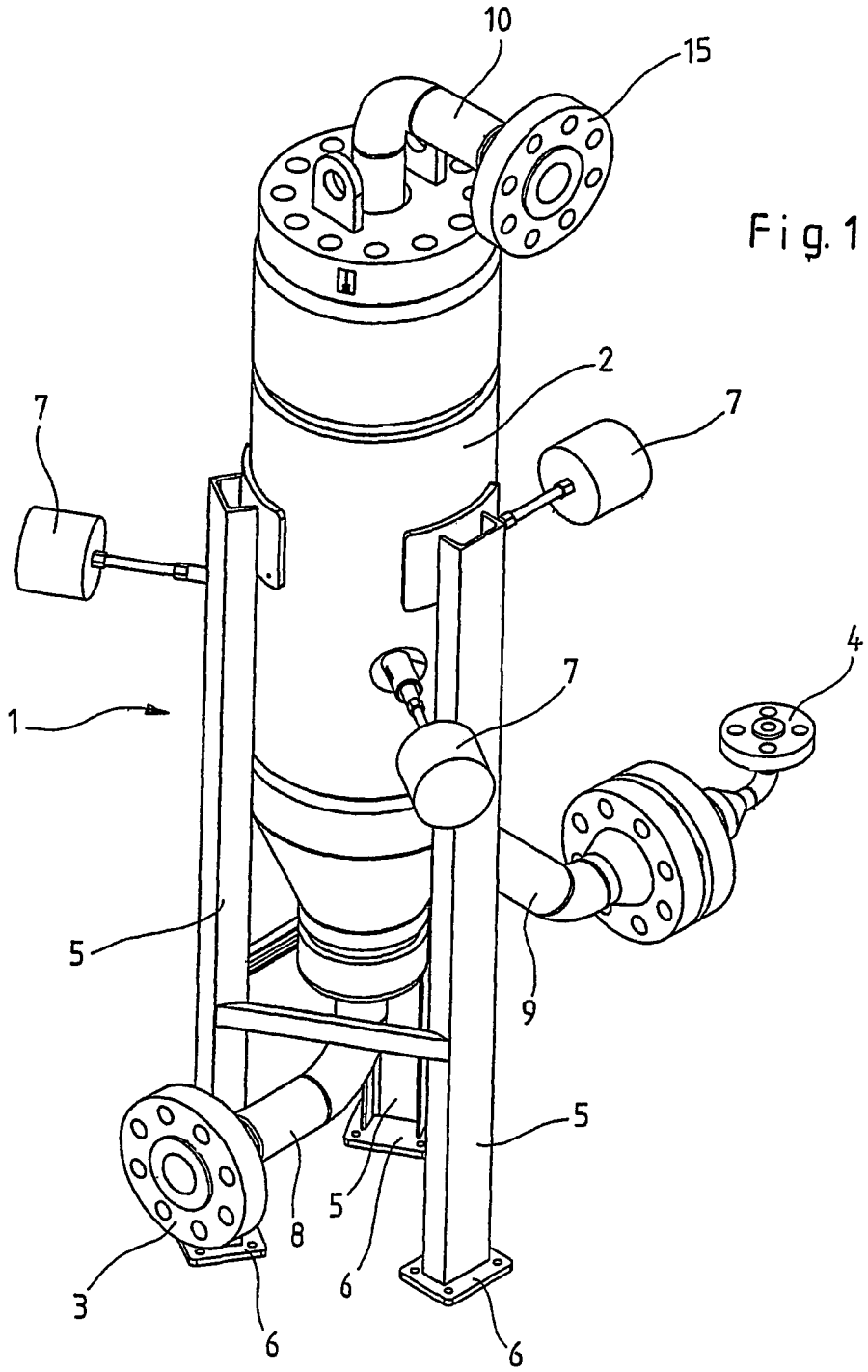
FIG. 1 shows a view of a closed mixing container of a device for continuously mixing fed-out natural gas and oxygen.

FIG. 1 shows a view of device for continuously mixing fed-out natural gas with oxygen to produce a burnable gas for heating the pressurised natural gas before or after the relaxation thereof. Formed through the connection 8, fitted with a flange 3 for a natural gas supply line into the mixing container, and through the connection, fitted with a flange 4, for an oxygen in-feed line to the mixing container 2 is the mixing section 1, which ends in the burnable gas discharge line 10 with flange 15

The mixing container 2 forming the mixing section 1 is a standing container with feet 5, at the lower ends of which there are base plates 5, which serve to anchor the mixing container 2 on a floor area.

The feet 5 and base plates 6 form a stand for the mixing container 2, into the bottom of which natural gas flows via the flange 3 and natural gas supply line 8, and into which oxygen is fed via the oxygen in-feed line 9 with the flange and mixed with the fed-in natural gas in the mixing container.

The gas mixture forms a burnable gas which is removed from the mixing container 2 via the burnable gas discharge line 10 with flange 15.

On the periphery of the mixing container 2, temperature sensors 7 are applied evenly distributed around the circumference.

Figure 2:
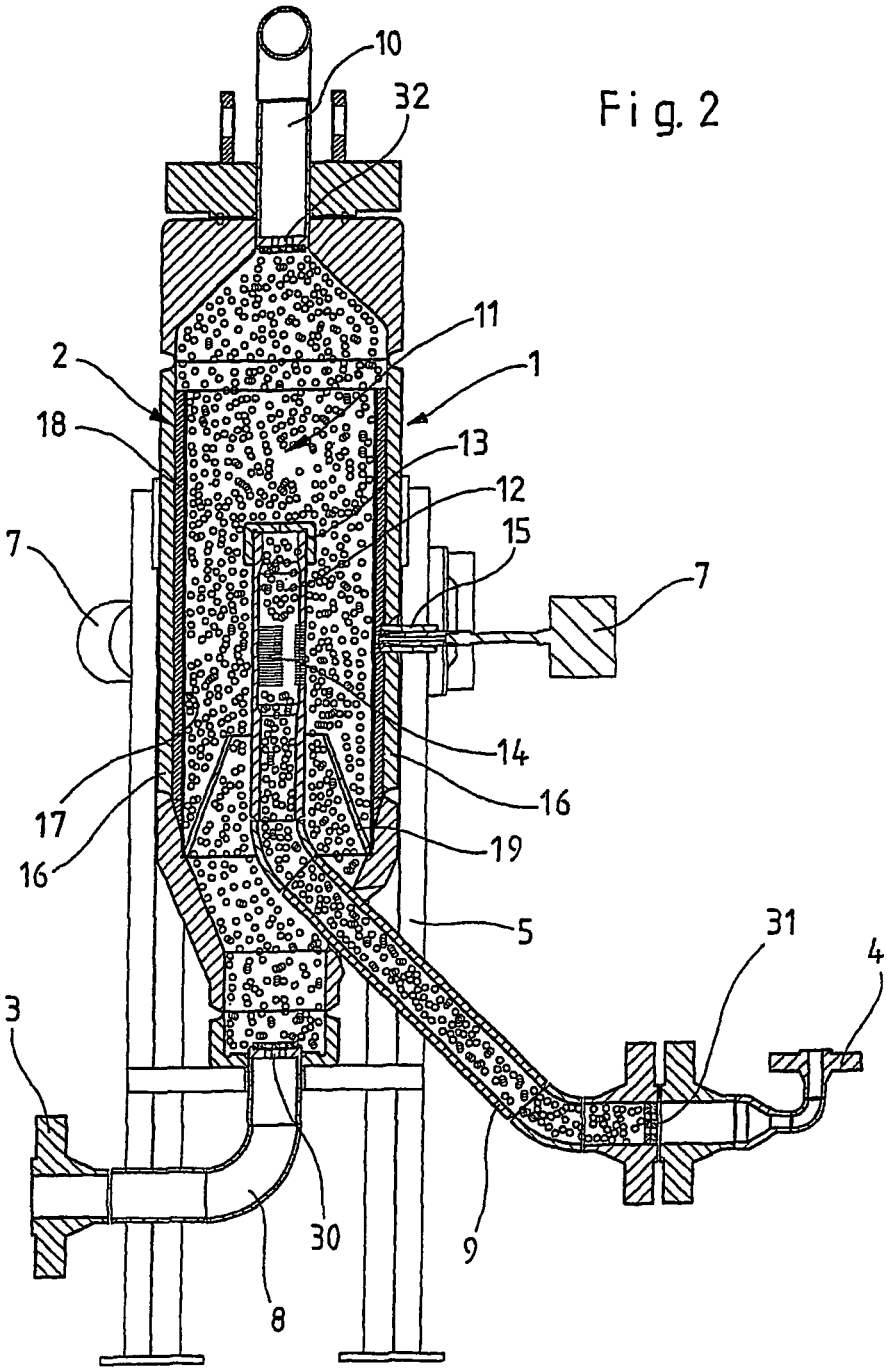
FIG. 2 shows a side view of the mixing container in longitudinal section, and FIG. 3 a schematic view of the device for continuous mixing with schematically indicated fittings upstream of the connections for a natural gas supply line and an oxygen in-feed line.

FIG. 2 shows a side view of the standing container 2 forming the mixing section 1 in longitudinal section. The same components are given the same reference numbers as in FIG. 1.

FIG. 2 shows that in the interior of the mixing container 2 there is a mixing chamber, which is filled with packing of ceramic granular material. The packing of ceramic granular material is indicated by drawn-in micro-circles.

Arranged in the centre of the mixing chamber 11 designed as the mixing zone is a distributing pipe 12 connected to the connection 9 for an oxygen in-feed line. The free end of the distributing pipe 12 is closed with an end cap 12. The section of the pipe wall of the distributor pipe 12 which runs parallel with the surrounding wall of the mixing container 2 is provided with outlet slits 14.

The distributing pipe is also filled, as indicated here; with the packing of ceramic granular materials, in this case a highly compacted aluminium oxide in spherical form with a homogeneous particle size distribution of 1.5 to 2 mm.

The inserts 30 and 31 in inlets 8, 9 and the insert 32 in outlet 10 serve to prevent the packing being carried out. At the same time the inserts 30, 31 and 32 bring about a homogenisation of the flow in the manner of a four-hole aperture.

FIG. 2 also shows that the temperature sensors 7 with a protective tube 15 are arranged in an area in the mixing container wall 16 which corresponds with the arrangement of the outlet slits 14 in the distributing pipe 12.

In the area of the mixing zone of the mixing chamber 11, the mixing chamber 2 has a double wall, whereby an insulating material 18 is arranged between the outer mixing container wall 16 and the inner mixing chamber wall 17.

On the inflow side, the mixing zone in the interior of the mixing chamber has a concentric cross-section narrowing 19 which increases the flow speed in the mixing zone. The cross section narrowing 19 can, for example, be a metal funnel which is placed the wrong way around into the lower end of the mixing container directly above the inlet of the natural gas supply line 8.

Figure 3:
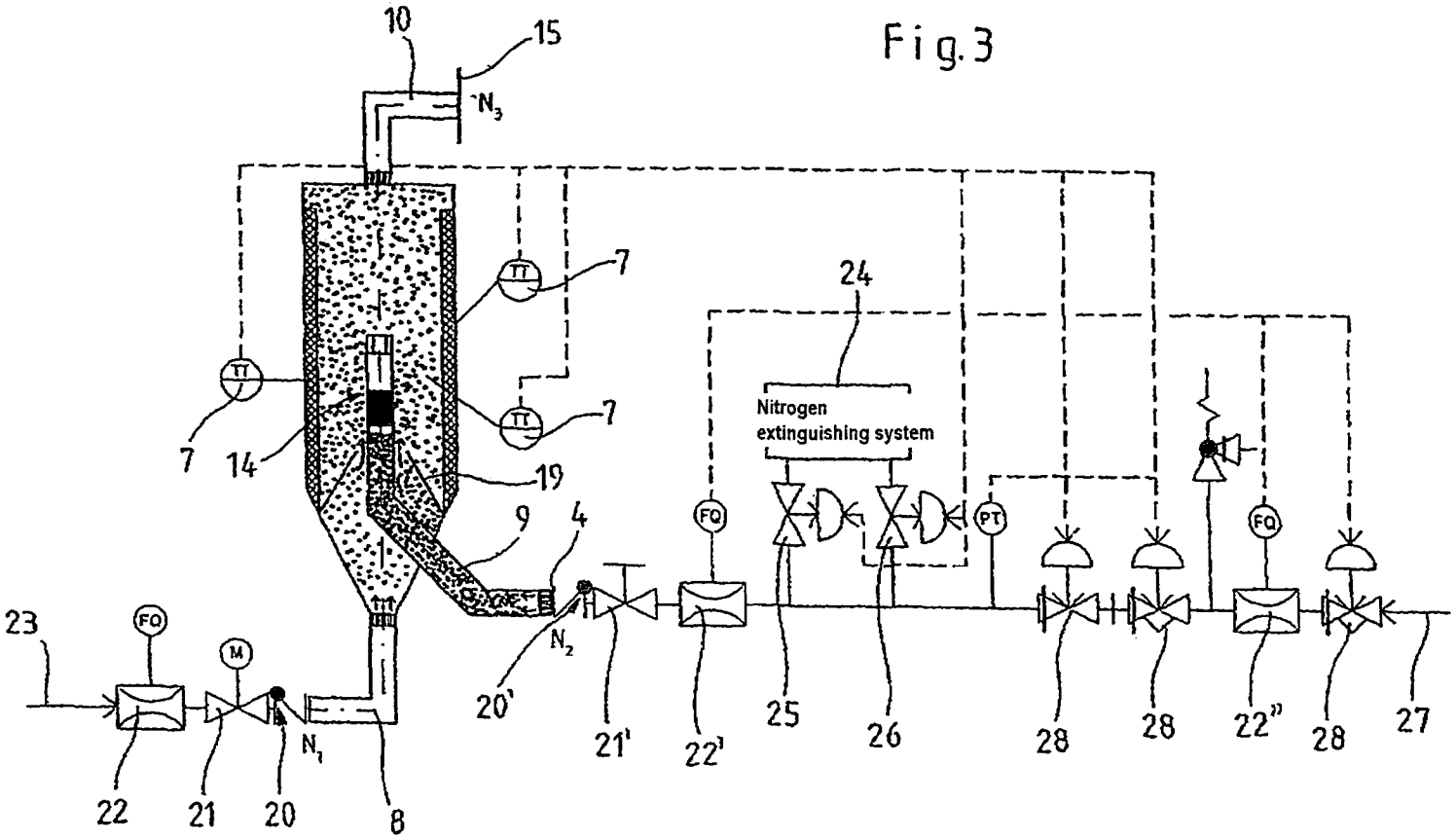

FIG. 3 shows a side view of the entire device with the mixing container and its connections for a natural gas supply line 8 and for an oxygen in-feed line with the fittings of a safety system upstream of these connections, with a nitrogen flushing system and with control fittings for the oxygen in-feed line.

The same components are again given the same reference numbers as in FIG. 1 and FIG. 2.

Upstream of the lower connection for the natural gas supply line 8 there is check valve 20 as well as a shut-off valve 21, upstream of which in turn, seen in the direction of the natural gas supply line, a quantity measuring device 22 is arranged.

The natural gas is supplied in the direction of arrow 23.

Arranged on the supply side of the oxygen in-feed line 9 with the inlet flange 4 is a check valve 20', before which, seen in the inflow direction of the oxygen, a shut-off valve 21' and device for measuring the quantity of oxygen 22' are located.

The latter fittings are component parts of the safety system of the device, to which the here only indicated nitrogen extinguishing device 24 with fittings 25 and 26 on the outlet side also belongs.

A further device for measuring the quantity of oxygen is marked 22".

A regulating device for the oxygen in-feed line, which controls the quantity of oxygen flowing in in the direction of the arrow 27, is marked 28.

These fittings too are part of the safety system, which in terms of process control can operate on the basis of a program with which the measurements of the temperature, pressure and quantity of oxygen and natural gas fed into the mixing chamber can be processed and controlled via the appropriate shut-off and regulating valves 21 and 28 and/or 21'.

The invention claimed is:

1. A device for continuously mixing fed-out natural gas with oxygen to produce a burnable gas for heating a pressurized natural gas before and after a relaxation thereof, comprising a mixing section with connections for natural gas supply line, an oxygen in-feed line and a burnable gas discharge line, wherein the mixing section comprises a closed standing mixing container, said mixing container having a mixing chamber at the center forming a mixing zone, and a distributing pipe for oxygen joined to the connection for an oxygen in-feed, wherein the mixing chamber is filled completely and the distributing pipe filled at least partially with a packing of ceramic granular material, wherein the mixing chamber of the mixing container is equipped with temperature sensors for measuring the temperature, and wherein the mixing container at the bottom has the connection for the natural gas supply line and at the top the connection for the burnable gas discharge line.

2. The device in accordance with claim 1, wherein a cross-section of the mixing zone narrows concentrically on an inflow side of the mixing zone which increases the flow speed in the mixing zone.

3. The device in accordance with claim 1, wherein the distributing pipe has outlet slits in its pipe wall running parallel to the surrounding walls of the mixing container.

4. The device in accordance with claim 1, wherein the ceramic granular material of the packing is a highly compressed aluminum oxide in spherical form with a homogeneous particle size distribution of 1.5 to 3 mm.

5. The device in accordance with claim 4, wherein the connection of the distributing pipe, the connection for the natural gas supply line and the connection for the burnable gas discharge line are fitted with sieve-like inserts.

6. The device in accordance with claim 1, wherein the mixing container has a double wall in the mixing zone, whereby an insulating material is arranged between an outer mixing container wall and an inner mixing chamber wall.

7. The device in accordance with claim 6, wherein the distributing pipe has outlet slits and on the inner mixing chamber container wall in an area corresponding to the arrangement of the outlet slits on the distributing pipe, several temperature sensors with a protective tube are arranged evenly distributed around the circumference of the outer mixing container wall.

8. The device in accordance with claim 7, wherein measuring functions of the temperature sensors are integrated into a safety system.

9. The device in accordance with claim 8, wherein the safety system has a nitrogen flushing system which is connected to the oxygen in-feed line.

10. The device in accordance with claim 9, wherein a measuring and control device is integrated into the oxygen in-feed line and into the natural gas supply line.

11. The device in accordance with claim 10, wherein each measuring and control device has at least one throughflow quantity measuring device.

12. The device in accordance with claim 8, wherein the safety system is equipped with at least one regulating device for the oxygen in-feed line.

* * * * *